United States Patent [19]

Aguilera

[11] Patent Number: 4,879,961

[45] Date of Patent: Nov. 14, 1989

[54] SAIL AIRFOIL DEVICE

[76] Inventor: Angel R. Aguilera, P.O. Box 1336, Crestline, Calif. 92325

[21] Appl. No.: 271,605

[22] Filed: Nov. 15, 1988

Related U.S. Application Data

[63] Continuation-in-part of Ser. No. 228,007, Aug. 3, 1988, abandoned.

[51] Int. Cl.[4] ..... B63H 9/06

[52] U.S. Cl. ..... 114/102; 114/106

[58] Field of Search ..... 114/39.1, 39.2, 102, 114/103, 104, 105, 106

[56] References Cited

U.S. PATENT DOCUMENTS

| | | | |
|---|---|---|---|
| 3,142,282 | 7/1964 | Nichols . | |
| 3,370,560 | 2/1968 | Lucht . | |
| 3,598,075 | 8/1971 | Kenney . | |
| 4,296,704 | 10/1981 | Bridge . | |
| 4,341,176 | 7/1982 | Orrison . | |
| 4,437,426 | 3/1984 | Latham . | |
| 4,465,010 | 8/1984 | Jalbert . | |
| 4,530,301 | 7/1985 | Latham . | |
| 4,593,638 | 6/1986 | Cochran et al. . | |
| 4,624,203 | 11/1986 | Ferguson . | |
| 4,637,331 | 1/1987 | Jackson . | |
| 4,646,671 | 3/1987 | Innes et al. . | |
| 4,690,088 | 9/1987 | Perini . | |
| 4,699,073 | 10/1987 | Farneti . | |
| 4,708,078 | 11/1987 | Legaignoux et al. . | |
| 4,708,079 | 11/1987 | Magnan . | |
| 4,733,624 | 3/1988 | Belvedere | 114/102 |
| 4,753,186 | 6/1988 | Paras | 114/103 |
| 4,757,779 | 7/1988 | Graveline | 114/103 |

FOREIGN PATENT DOCUMENTS

| | | | |
|---|---|---|---|
| 2658772 | 7/1978 | Fed. Rep. of Germany | 114/102 |
| 3211641 | 10/1983 | Fed. Rep. of Germany | 114/103 |
| 603392 | 8/1978 | Switzerland | 114/102 |
| 1153056 | 5/1969 | United Kingdom | 114/102 |

*Primary Examiner*—Sherman D. Basinger
*Assistant Examiner*—Stephen P. Avila
*Attorney, Agent, or Firm*—Gordon L. Peterson; Loyal M. Hanson

[57] ABSTRACT

An airfoil device includes an inflatable structure for attachment to an existing sail to form a sail assembly. The inflatable structure is dimensioned and arranged to extend over a substantial portion of the existing sail and a valve arrangement is included for enabling a user to inflate and deflate the inflatable structure while it is so attached to thereby vary the sail assembly shape. The inflatable structure includes inner and outer layers that define an enclosed interior suitable to contain a pressurized gas for inflation purposes, and they are dimensioned and arranged to provide an airfoil shape to the sail assembly when the inflatable structure is inflated. The inflatable structure may be arranged to be either removably or fixedly attached, and various configurations are disclosed to enable use with various types of sails for all points of sailing under various wind conditions.

20 Claims, 9 Drawing Sheets

SAIL AIRFOIL DEVICE

CROSS REFERENCE TO RELATED APPLICATION

This application is a continuation-in-part of the copending U.S. patent application Ser. No. 228,007 filed Aug. 3, 1988 naming the same inventor now abandoned.

BACKGROUND OF THE INVENTION

1. Technical Field

This invention relates generally to sailing, and more particularly to a device for enhancing sail performance.

2. Background Information

An airfoil shape can significantly improve sail performance and many existing sails are designed accordingly. Besides presenting a more streamlined shape that eliminates eddy currents, the airfoil shape results in more propulsive force and correspondingly more speed. Thus, the details of design and construction of airfoil equipment for sailing are of interest.

Some existing airfoil sails are rigid or semi-rigid structures. As a result, they are difficult to manipulate and stow. In addition, they may be fixed to the mast where they are left to the mercy of the wind. Furthermore, some airfoil sails are not adaptable for use with different types of existing sails such as jib sails, main sails, roller jib sails, drifter sails, and spinnaker sails. Instead, they are dedicate to one particular use and a particular wind condition.

Consequently, it is desirable to have a new add improved sail airfoil device that alleviates these concerns—one designed to provide the benefit of an airfoil shape that is convenient to use with existing equipment and adaptable to use for all points of sailing under different wind conditions. This invention will also show the user the need of this invention on their sail craft because it can be used to eliminate the spinnaker and its associated rigging which are costly and difficult to manipulate.

SUMMARY OF THE INVENTION

This invention solves the problems outlined above with an inflatable airfoil device that can be applied to various types of existing sails and inflated to provide the desired airfoil shape. Thus, it can be deflated and stowed when not in use. It is convenient to manipulate, adaptable to different types of existing sails, and highly functional.

Generally, an airfoil device constructed according to a major aspect of the invention includes an inflatable structure for attachment to an existing sail to form a sail assembly. The inflatable structure is dimensioned and arranged to extend over a substantial portion of the existing sail and a valve arrangement is included for enabling a user to inflate and deflate the inflatable structure while it is so attached to thereby vary the sail assembly shape. The inflatable structure includes inner and outer layers that define an enclosed interior suitable to contain pressurized gas for inflation purposes, and they are dimensioned and arranged to provide an airfoil shape to the sail assembly when the inflatable structure is inflated.

The inflatable structure may be attached removably by hook-and-loop type fasteners or fixedly by stitching and bonding, and various configurations are disclosed to enable use with various types of sails for all points of sailing under various wind conditions.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
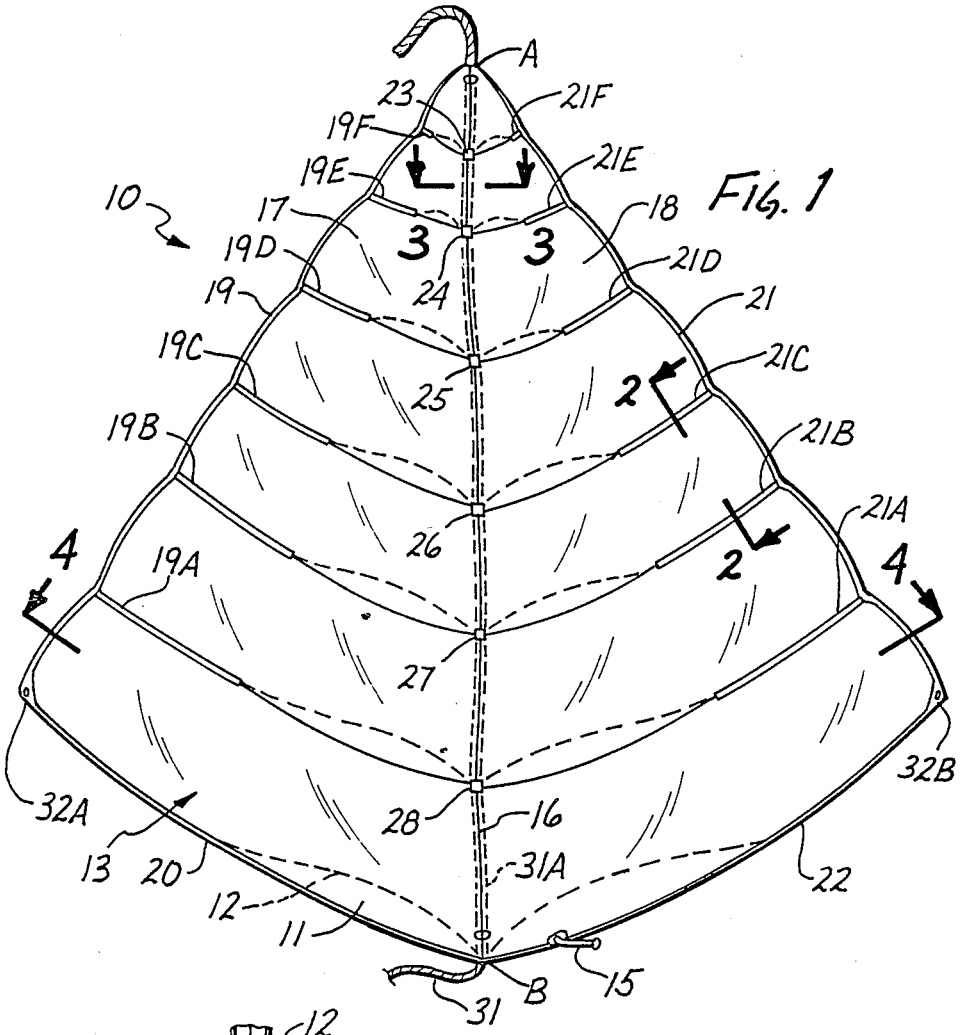
FIG. 1 of the drawings is a front view of a twin airfoil device constructed according to the invention.
Figure 2:
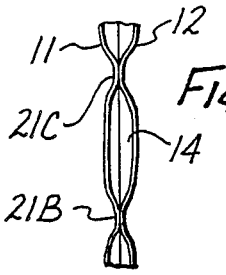
FIGS. 2–4 are enlarged details of the twin airfoil device of FIG. 1.

Referring first to FIGS. 1–4 of the drawings, there is shown an airfoil device 10 constructed according to the invention that is shown in an opened position. It includes a first layer 11 and a second layer 12 that define an inflatable structure 13 for attachment to an existing sail to form a sail assembly.

The inflatable structure 13 is dimensioned and arranged to extend over a substantial portion of the existing sail as subsequently described. The inner and outer layers 11 and 12 define an enclosed interior 14 suitable for containing a pressurized gas for inflation purposes, and the inner and outer layers 11 and 12 are dimensioned and arranged to provide an airfoil shape to the sail assembly when the inflatable structure 13 is inflated.

A commercially available air valve 15 is provided for enabling a user to inflate and deflate the inflatable structure 13 to vary its shape and thereby the shape of the sail assembly. The valve 15 may be any of various suitable types, such as one that can be twisted between open and closed positions. It attaches to a suitable source of pressurized gas, such as a conventional foot pump, to communicate the pressurized gas to the interior 14 for inflation purposes. As this is done, the inflatable structure 13 inflates to provide an airfoil shape.

Once inflated, the valve 15 is closed and the pump removed. To deflate the inflatable structure 13, the valve 15 is opened, and this allows the pressurized gas to escape.

The inflatable structure 13 is fabricated by joining the first and second layers 11 and 12 at various locations by known means such as stitching and bonding. The first and second layers are composed of any of various known flexible, airtight materials, and they extend from a central portion 16 (FIG. 1) to form first and second sections 17 and 18 of the inflatable structure 13.

The central portion 16 extends from a point A or head A on the inflatable structure 13 to a point B or foot B (FIG. 1). The first section 17 of the inflatable structure 13 extends intermediate the central portion 16 and marginal edge portions 19 and 20, and the second section 18 extends intermediate the central portion 16 and marginal edge portions 21 and 22.

Figure 3:
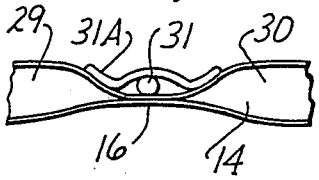
Figure 4:
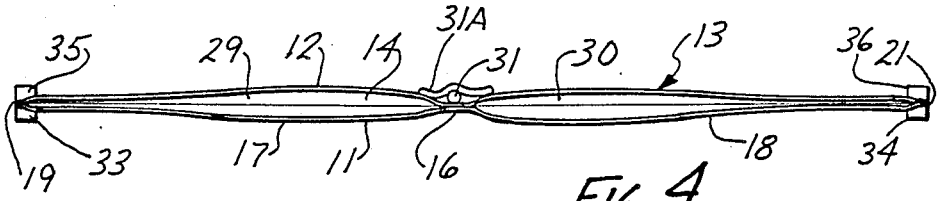

The first and second layers 11 and 12 are bonded together at locations 23–28 along the central portion 16 and along the marginal edge portions 19–22 so that the interior 14 is fully enclosed, enabling the inflatable structure 13 to contain a quantity of pressurized gas for inflation purposes. The first and second layers 11 and 12 are not bonded along the central portion 16 over the full distance between the points A and B, however, in order to leave air passages between adjacent ones of the locations 23–28 that provide fluid communications between first and second portions 29 and 30 of the interior 14 (FIGS. 3 and 4).

A plurality of creases 19A–19F and 21A–21F are formed in the inflatable structure 13 by bonding the first and second layers 11 and 12 together at spaced apart intervals along the marginal edge portions 19 and 21. These creases and the size and shape of the layers 11 and 12 are arranged according to known techniques to provide shaping to the inflatable structure 13 that results in the desired airfoil shape.

A luff rope 31 is included, threaded between the second layer 12 and a luff rope protection panel 31A. The panel 31A is attached to the second layer 12 by suitable means such as bonding. The luff rope 31 is used to attach the head A and foot B of the airfoil device to an existing sail.

The airfoil device 10 includes means on the inflatable structure 13 for attaching it to an existing sail. This is accomplished in the illustrated embodiment with first and second fastener strips 33 and 34 that mate with similar strips mounted on the existing sail. This enables a user to attach the inflatable structure 13 to the existing sail removably by pressing the fastener strips 33 and 34 against mating strips on the existing sail. Clew cringles 32A and 32B are provided to secure the airfoil device 10 to the clew of the existing sail by conventional means.

Various fasteners can be used for this purpose within the broader inventive concepts disclosed. The strips 33 and 34 are hook-and-loop type fasteners such as those sold under the trademark VELCRO by Velcro USA Inc. of Manchester, N.H. Where it is desired to attach an airfoil device to an existing sail fixedly, as subsequently described, other attachment means may be employed, such as bonding and/or stitching a marginal edge portion of the inflatable structure to an existing sail.

The illustrated first and second strips 33 and 34 are used to attach the airfoil device 10 between the layers of an existing double-layered sail as subsequently discussed. Similar third and fourth fastener strips 35 and 36 are also provided on the illustrated airfoil device 10 for use in attaching the airfoil device 10 to an existing single-layered sail. Attachment to an existing double-layered sail is illustrated in FIG. 5 and attachment to an existing single-layered sail is illustrated in FIGS. 6 and 7.

Figure 5:
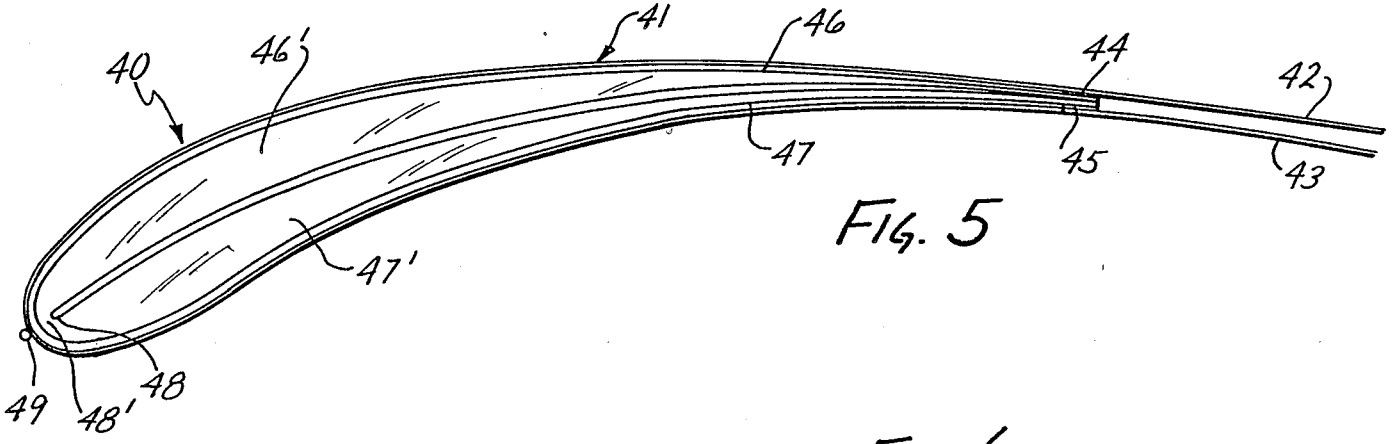
FIG. 5 shows a twin airfoil device enclosed by a double layered sail.

Considering first FIG. 5, there is shown an airfoil device 40 attached to an existing double-layered sail 41 between first and second layers 42 and 43 of the double-layered sail 41. The airfoil device 40 is generally similar to the airfoil device 10 already described except that it does not have third and fourth fastener strips that are the counterparts of the strips 35 and 36 of the airfoil device 10. It does have first and second fastener strips 44 and 45 on respective ones of first and second sections 46 and 47 (the counterparts of first and second sections 17 and 18 of the inflatable structure 13), and these attach to mating strips on the double-layered sail 41.

The airfoil device 40 folds along a central portion 48 (the counterpart of central portion 16) to enable it to be used with the double-layered sail 41 in this manner. Together, the airfoil device 40 and sail 41 form what may be called a sail assembly, and once this sail assembly is formed and hoisted into operating position, the airfoil device 40 is inflated to produce the desired airfoil shape as illustrated. Air pressure is equalized between first and second interior portions 46' and 47' by air passage chambers 48'. A luff rope 49 may be used to hoist the sail assembly, or an arrangement employing jib hanks can be used.

Figure 6:
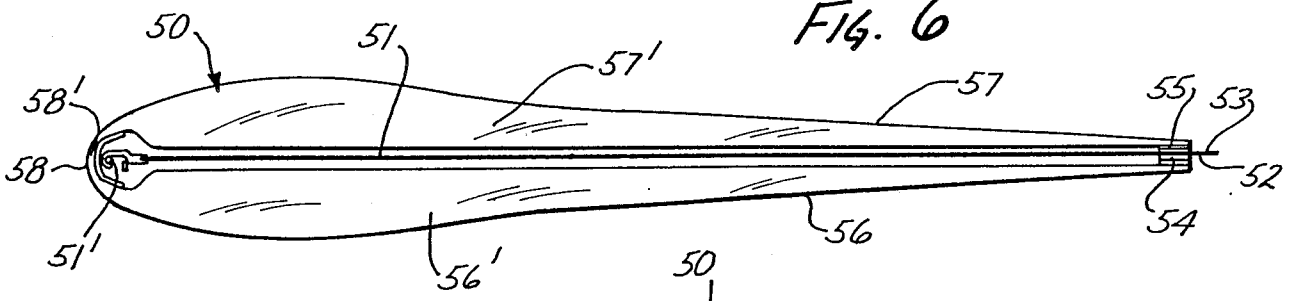
FIGS. 6 and 7 show a twin airfoil device applied to a single layered sail.
Figure 7:
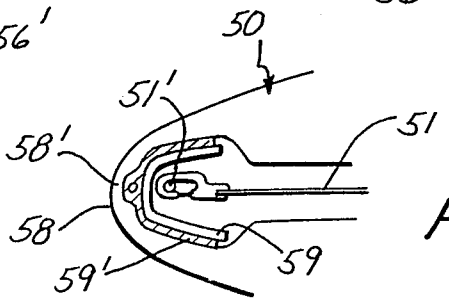

FIGS. 6 and 7 show an airfoil device 50 attached to an existing single-layered sail 51. The airfoil device 50 is attached over first and second sides 52 and 53 of the single-layered sail 51 and the sail 51 is hanked on a jib stay 51'. Of course, the inventive concepts also apply where the existing single-layered sail includes a luff rope within a track.

The airfoil device 50 is generally similar to the airfoil devices 10 and 40 already described except that it does not have first and second fastener strips that are the counterparts of the strips 33 and 34 of the airfoil device 10 and the strips 44 and 45 of the airfoil device 40. It does have third and fourth fastener strips 54 and 55 on respective ones of first and second sections 56 and 57 (the counterparts of first and second sections 17 and 18 of the inflatable structure 13), and these attach to mating strips on the single-layered sail 51.

The airfoil device 50 folds along a central portion 58, and once a sail assembly is formed and hoisted into operating position, the airfoil device 50 is inflated to produce a desired airfoil shape as illustrated. Inflated pressure is equalized between first and second interior portions 56' and 57' by air passage chambers 58'. For use in this way, the airfoil device 50 includes an airfoil protection panel 59 that is bonded at 59' to the rest of the airfoil device. This provides protection against chaffing.

Figure 8:
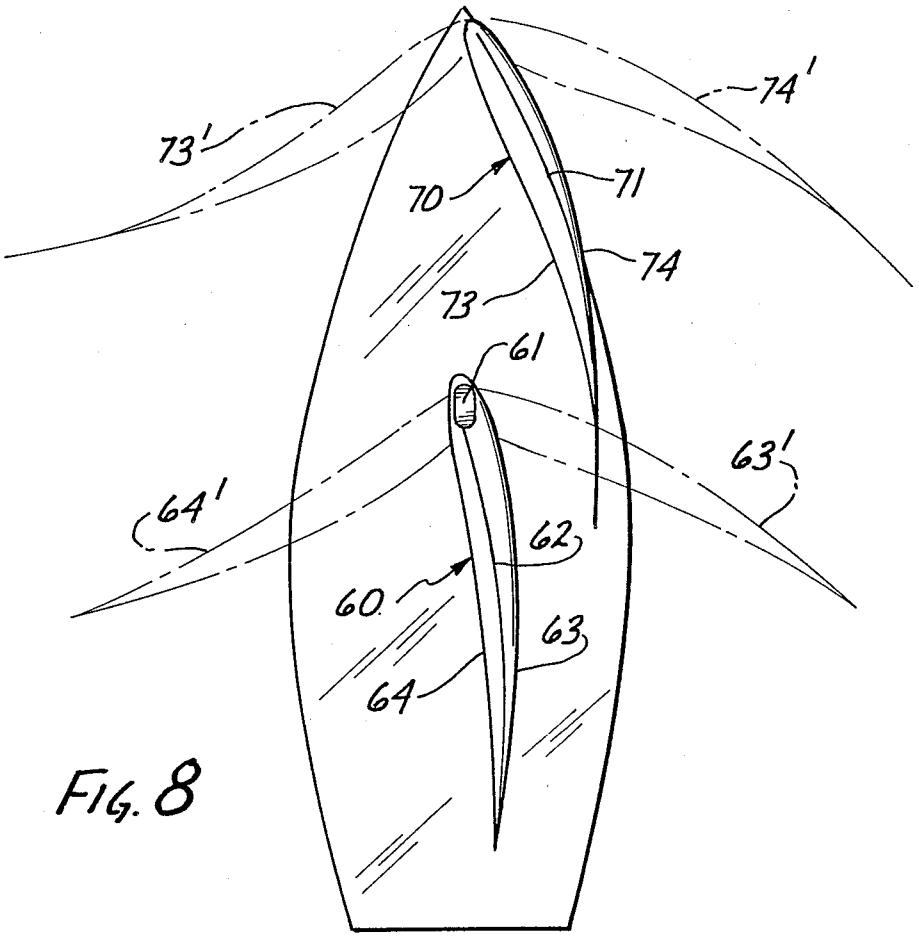
FIG. 8 illustrates a downwind application of the twin airfoil device.

FIG. 8 is a diagrammatic view showing use of two airfoil devices constructed according to the invention as wing sails for downwind use. This application will illustrate why the spinnaker and its associated rigging which is costly and difficult to handle can be eliminated. A first airfoil device 60 is shown hoisted on a mast 61 with a main sail 62. For downwind use, a first section 63 of the first device 60 is detached from the mail sail 62 and moved to the position shown in phantom lines that is designated by 63'. The second section 64 is left attached to the main sail 62 and moved to position 64'.

A second airfoil device 70 is shown used with a jib sail 71. For downwind use, a first section 73 of the airfoil device 70 is detached from the jib sail 71 and moved to the position 73'. The second section 74 is left attached to the jib sail 71 and moved to position 74'.

Figure 9:
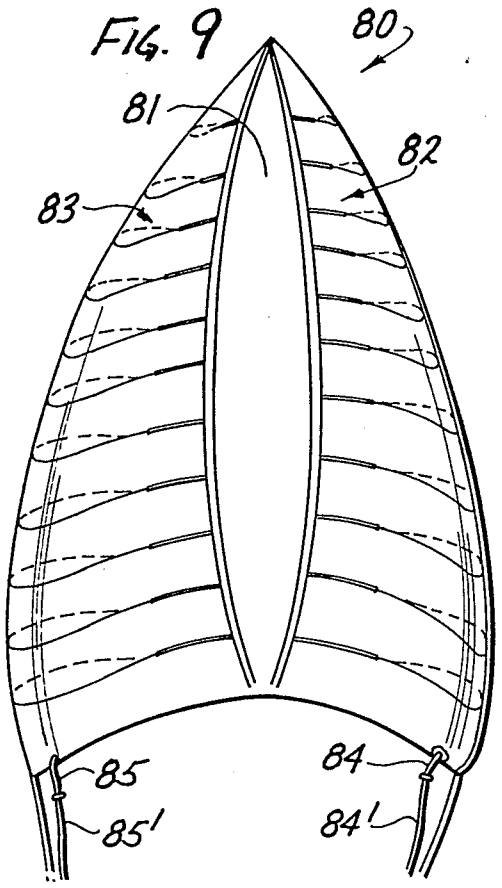
FIG. 9 shows two airfoil devices applied to both luffs of a spinnaker.

An assembly 80 is illustrated in FIG. 9 that is configured for use with an existing spinnaker 81. It includes a first airfoil device 82 attached to the starboard side of the spinnaker 81 and a second airfoil device 83 attached to the port side of the spinnaker 81. The two airfoil devices 82 and 83 are similar in many respects to those already described except that they are dimensioned and arranged for this particular use and they are separately inflatable and deflatable by using respective ones of valves 84 and 85. Extension lines 84' and 85' may also be used to enable inflation and deflation from the cockpit.

During a port side point of sail, for example, the airfoil device 83 is inflated and the airfoil device 82 is left deflated. When tacking to a starboard point of sail, the crew simply removes the air supply from the supply line for the port side or second airfoil device 83 (extension line 85' ) and moves it to the supply line for the starboard or first airfoil device 82 (extension line 84' ).

Figure 10:
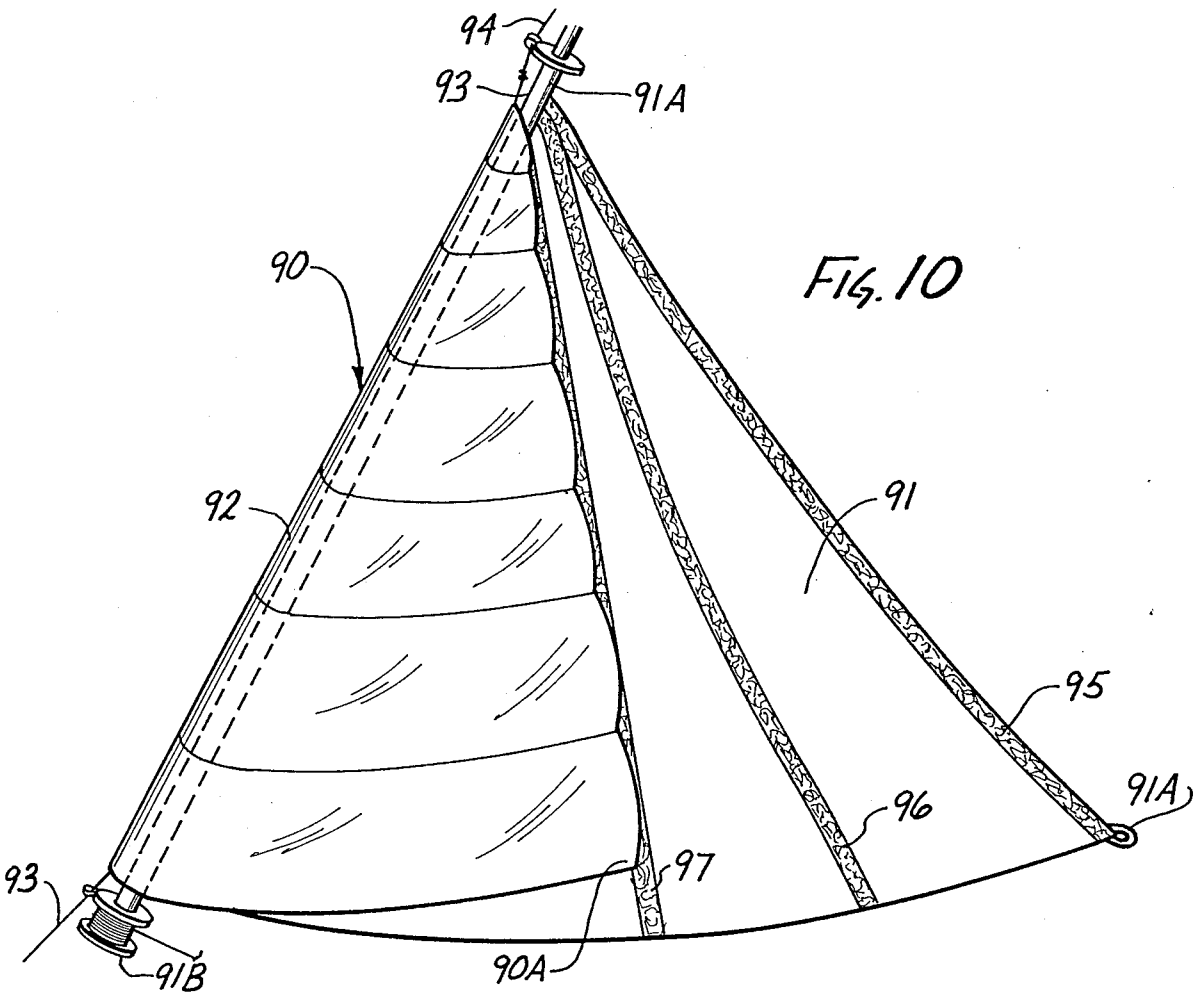
FIG. 10 shows an airfoil device applied to a roller furling jib.

FIG. 10 illustrates yet another application in which an airfoil device 90 is used with a roller furling jib 91 that can be rolled onto a roller spool 91A by operation of a roller furling mechanism 91B according to known techniques using existing equipment. A central portion 92 of the airfoil device 90 folds over the roller spool 91A in the position illustrated and an airfoil luff rope 93 is secured to a halyard 94 to hoist the airfoil device 90 into position. The clew 90A of the airfoil device 90 is secured to the clew 91A of the existing jib sail by conventional means such as an adjustable length of line or an adjustable strap.

This overcomes some problems encountered when reducing the sail onto the roller spool, such as sail stretch in the pocket of the sail by wind and uncontrollable shaking of the stay by the wind. These problems are overcome by the airfoil device 90 enclosing the stretch area and the jib spool area.

The sailmaker can add as many fastener strips to the existing jib sail as the user desires, three such strips 95–97 being illustrated. Then, when the user changes the position of the roller jib 91, the airfoil device 90 can be detached from one of the fastener strips and reattached to another.

Considering now FIGS. 11 and 12, there is shown an airfoil device 100 that adds sail area 100A below the boom 106. This same sail area 100A can be reefed. It is attached to a main sail 101 and supported with the main sail on a mast 102. The airfoil device 100 is similar in many respects to the airfoil devices described above, and multiple fastener strips 101A and 101B are provided on the main sail 101 so that the position at which the airfoil device 100 is attached to the main sail 101 can be changed in a manner similar to that described above for the roller furling jib 91 after the main sail 101 has been reefed.

Figure 11:
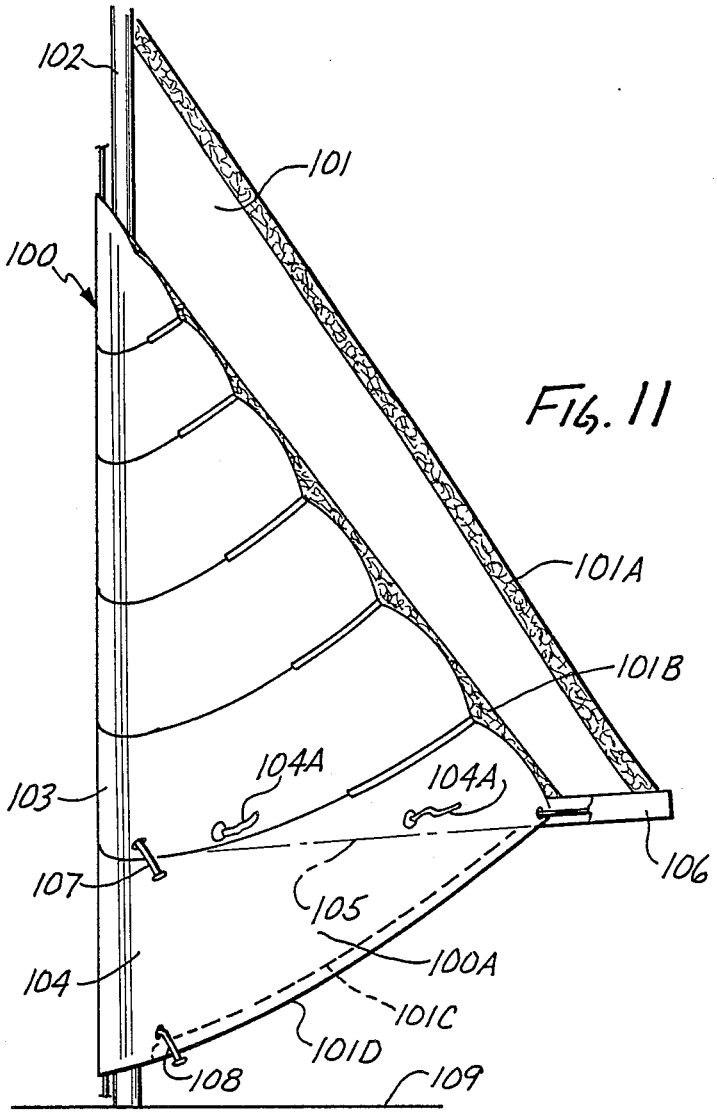
FIGS. 11 and 12 show an airfoil device applied to a main sail with a second air compartment enabling reefing, of the main sail or of the airfoil device.
Figure 12:
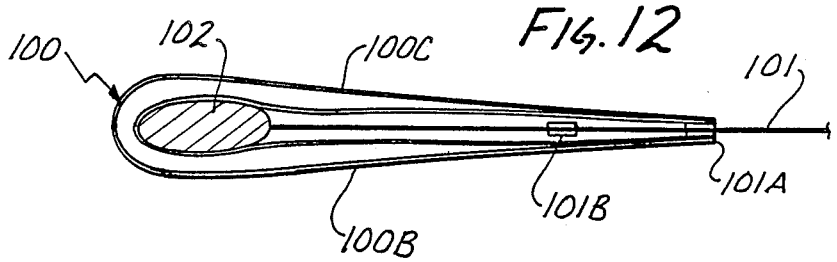

Unlike the airfoil devices already described, the airfoil device 100 has separately inflatable and deflatable upper and lower portions 103 and 104 that meet at a location on the airfoil device 100 depicted by a phantom line 105 in FIG. 11. This location is in the vicinity of the boom 106. A fastener strip and mating strip 101C are added to the foot 101D of airfoil device 100 to prevent wind from entering between the port section 100B and the starboard section 100C of the airfoil device 100. Two valves 107 and 108 are provided so that the user can separately inflate and deflate the upper and lower portions 103 and 104. With the lower portion 104 deflated, it can be conveniently reefed with reefing ties 104A as desired according to such factors as the distance above the deck 109 that the airfoil device 100 is positioned. The reefing ties 104A are bonded to the airfoil device 100.

Figure 13:
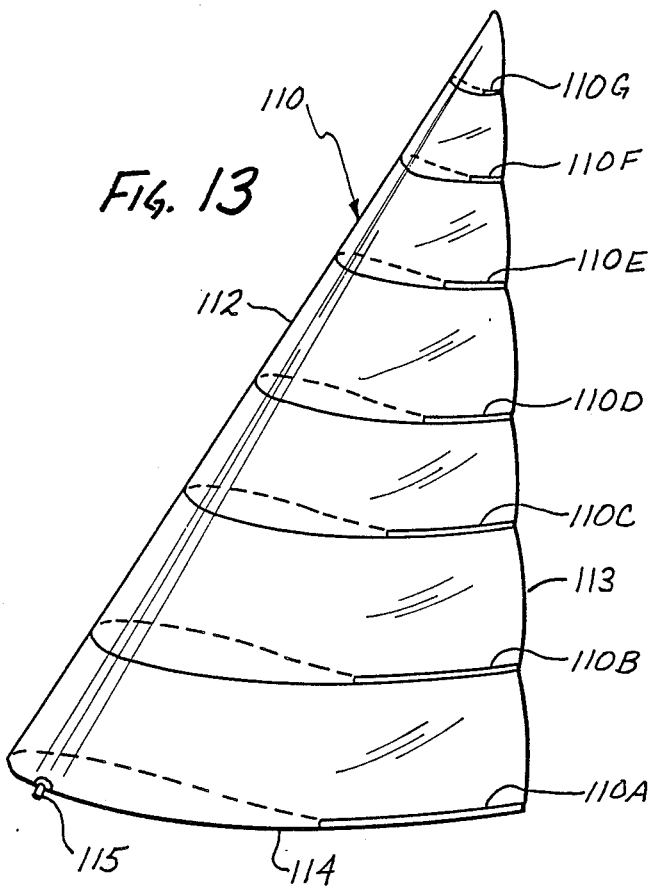
FIGS. 13 and 14 show a single airfoil device constructed according to the invention.
Figure 14:
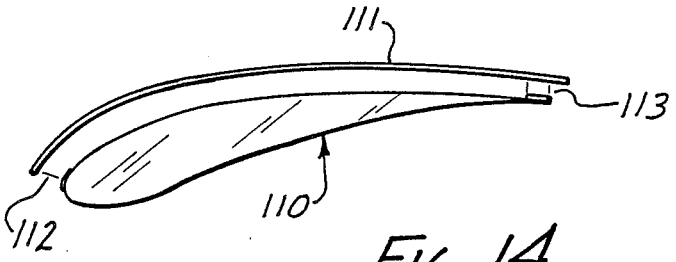

FIGS. 13 and 14 show an airfoil device 110 attached to an existing jib sail 111. The airfoil device 110 is similar in general to just one section of the airfoil device 10 described previously. In other words, it does not include first and second sections that cover both sides of a single-layered sail. Instead, it covers just one side. Although a single-layered sail is shown, the airfoil device 110 can be attached to a double-layered sail as well.

So configured, it may be fabricated from one continuous layer of material, and be attached by bonding at 112 along the luff of the existing jib sail 111 and stitching and bonding along the leech 113 and the foot 114. Creases 110A–110G provide shaping and a valve 115 is used to inflate and deflate the device 110.

Figure 15:
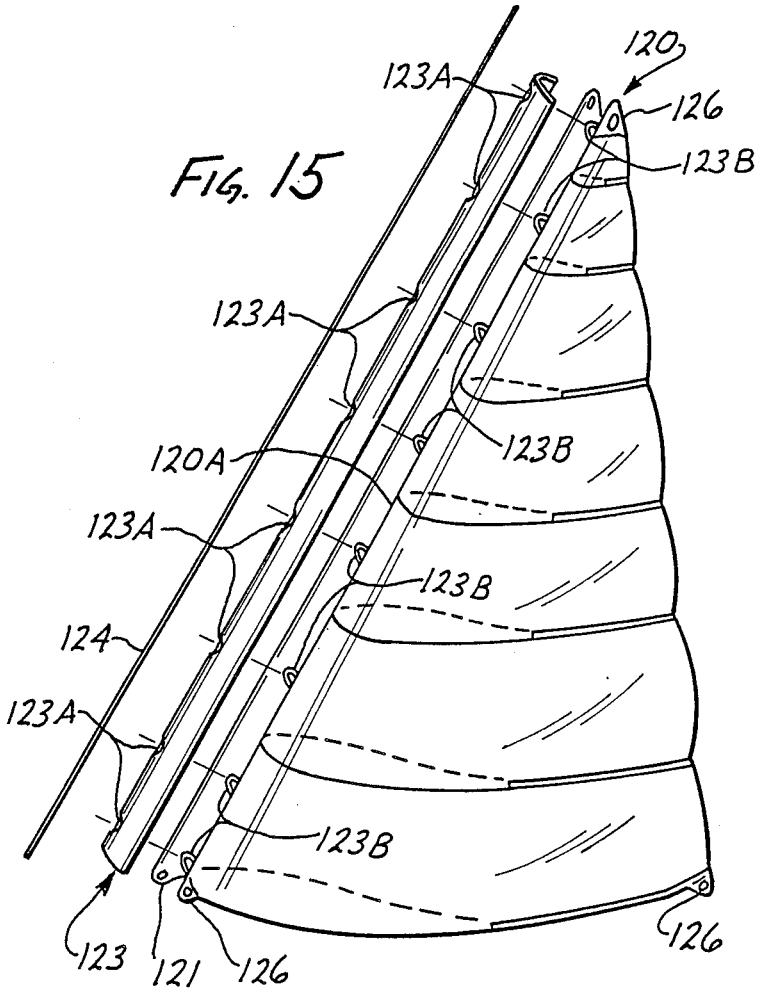
FIGS. 15 and 16 show a single airfoil device applied to a jib sail.
Figure 16:
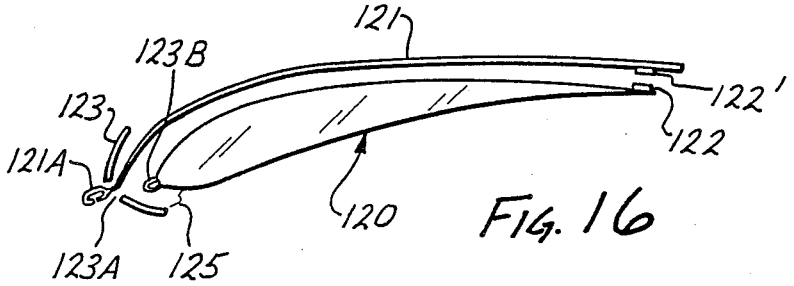

FIGS. 15 and 16 show an airfoil device 120 attached to an existing jib sail 121. The airfoil device 120 is generally similar in many respects to the airfoil device 110 described above. However, the airfoil device 120 includes a fastener strip 122 that mates with a similar fastener strip 122' on the jib sail 121 to enable it to be attached removably.

The airfoil device 120 also includes a wind passage prevention flap 123. As shown in the exploded view of FIG. 15, the flap 123, which has openings or holes 123A built into it, is positioned between the airfoil device 120 and a jib stay 124 by which the sail assembly is to be supported. Reinforced luff loops 123B, which are bonded to the luff 120A of the airfoil device 120, are slipped over the existing sail's jib hanks' 121A, and the jib sail hanks 121A are pulled through flap openings 123A and attached to the jib stay 124. This results in the flap 123 overlapping the luff of the jib sail 121 to prevent the wind from passing between the airfoil device 120 and the jib sail 121.

The flap 123 may be bonded at 125 to the rest of the airfoil device 120 in the position shown in FIG. 16. In addition, the airfoil device 120 may be provided with a reinforced loops 126 for the clew, head, and tack (FIG. 15).

Figure 17:
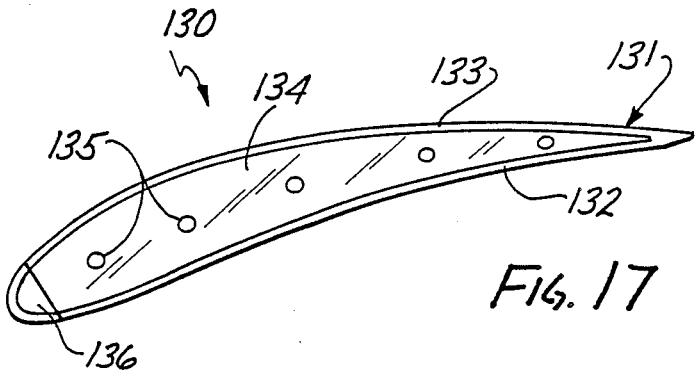
FIGS. 17 and 18 show the gussets employed in two preferred embodiments.
Figure 18:
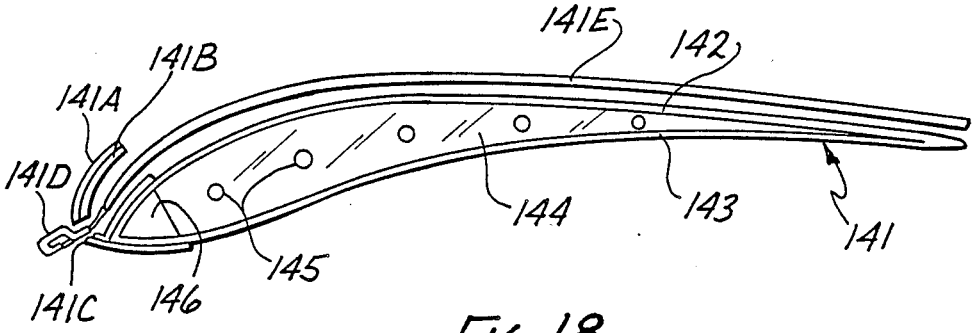

Considering now FIGS. 17 and 18, there are shown two embodiments that employ gussets, designated respectively airfoil devices 130 and 140. These embodiments are similar in many respects to those already discussed and they may be attached to an existing sail by suitable means, including hook-and-loop type fasteners, in the manner described above.

The airfoil device 130 is similar in many respects to the airfoil device 110 illustrated in FIGS. 13 and 14. It includes an inflatable structure 131 having an inner layer 132 and an outer layer 133 that combine when inflated to define an airfoil shape. Unlike the airfoil device 110, however, the inflatable structure 131 of the airfoil device 130 includes a gusset-like member or gusset 134 that serves as means to hold or restrain the inner and outer layers 132 and 133 in the airfoil shape when the inflatable structure 131 is inflated.

The gusset 134 is fabricated from an air tight material such as that used for the inner and outer layers 132 and 133 and it is attached by suitable means, such as bonding, to the inner and outer layers 132 and 133 in a position between the inner and outer layers. It has a shape such that when the inflatable structure 131 is inflated, with air pressure forcing the inner and outer layers 132 and 133 apart, the gusset 134 restrains them in a desired airfoil shape. Of course, the gusset 134 can have any of various shapes for this purpose.

In addition, a plurality of spaced-apart, generally parallel gussets may be used (not shown) and each may define a series of openings, such as the openings 135 in the gusset 134 (FIG. 17), that serve as passages for communicating pressurized gas between the gussets. The gusset 134 may be configured to provide a passage 136 for this purpose also. Although no gussets are described for the various embodiments of the invention described above with reference to FIGS. 1–16, gussets similar to the gusset 134 may be included in those embodiments within the broader inventive concepts disclosed.

The airfoil device 140 (FIG. 18) is similar in many respects to the airfoil device 120 illustrated in FIGS. 15 and 16. It includes an inflatable structure 141 having an inner layer 142 and an outer layer 143 that combine when inflated to define an airfoil shape.

There are some differences apart from the use of a gusset. Unlike the airfoil device 120, the panels 141A and 141B define openings, such as an opening 141C in FIG. 18, through which a jib hank 141D extends. The luff loops 123B of the airfoil device 120 have been eliminated and the panels have been bonded to the luff of the port side and the starboard side of the airfoil device 140. The panels are then bonded together to form a flap similar to the flap 123 in FIGS. 15 and 16 that prevents passage of wind between the sail 141E and the airfoil device 140. The flap has a series of openings similar to the openings 123A in FIGS. 15 and 16, including the opening 141C in FIG. 18, which receive the jib hanks of the existing sail 141E. The flap also secures the luff of the airfoil device 140 to the sail and the jib stay.

In addition, the inflatable structure 141 of the airfoil device 140 includes a gusset-like member or gusset 144 that is similar to the gusset 134 of the airfoil device 130. It serves as means to hold or restrain the inner and outer layers 142 and 143 in the airfoil shape when the inflatable structure 141 is inflated. Like the gusset 134, the gusset 144 is fabricated from an air tight material and it is attached by suitable means to the inner and outer layers 142 and 143. The gussett 144 may define a series of openings 145 that serve as passages for communicating pressurized gas through the gussets. A passage 146 is also provided, and the inflatable structure 141 may utilize a plurality of spaced-apart, generally parallel gussets similar to the gusset 144.

Figure 19:
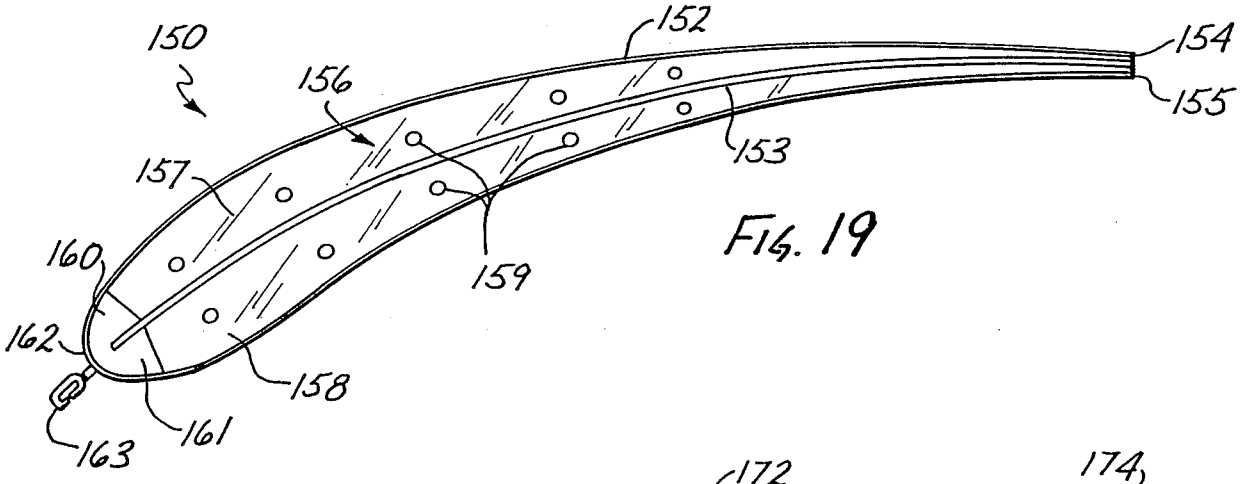
FIGS. 19 and 20 show airfoil-shaped sails that are used without having to be attached to an existing sail.
Figure 20:
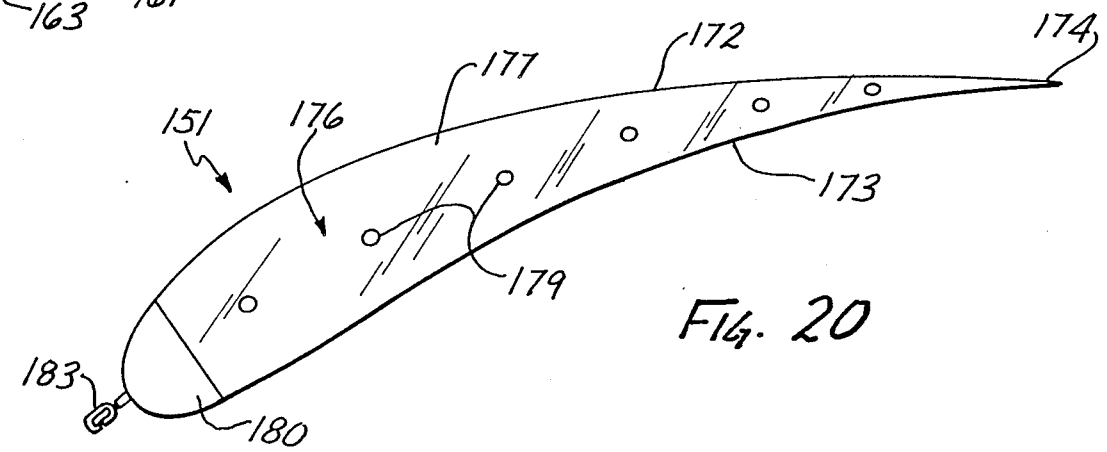

Considering now FIGS. 19 and 20, there are shown two airfoil-shaped sail assemblies or sails 150 and 151 that are constructed according to other aspects of the invention. They are designed to be used independent of an existing sail as independent double-layered and single-layered sails. In other words, they are used without having to be attached to an existing sail, and this concept can be used for a jib sail or a main sail as well.

The sail 150 is similar in some respects to the airfoil device 40 illustrated in FIG. 5. But instead of being used by attachment to an existing sail, such as the double-layered sail 41 in FIG. 5, it is used independently. It is an inflatable structure dimensioned and arranged for use as a sail on a sailing vessel. It includes valve means for enabling a user to inflate and deflate the inflatable structure while the inflatable structure is so used to thereby vary the shape of the sail. This aspect is not illustrated in FIGS. 19 and 20, but it is similar to that of described previously. It may also include a head cringle, a foot cringle, two clew cringles, and other structural components suited to the particular application.

Regardless of the particular application, the sail 150 includes first and second layers 152 and 153 of an airtight material (that term including a material that is treated to be generally airtight), which first and second layers are dimensioned and arranged to provide an airfoil shape to the sail when the inflatable structure is inflated; and. The first and second layers 152 and 153 are joined together by suitable means such as bonding along outer edges 154 and 155 to form an inflatable structure having an interior 156 that is fully enclosed, enabling the inflatable structure to contain a quantity of pressurized gas for inflation purposes.

Gussets 157 and 158 are provided, bonded to the first and second layers 152 and 153, and these serve as means for restraining or holding the first and second layers in the airfoil shape when the inflatable structure is inflated. The gussets 157 and 158 are fabricated from an air tight material, such as that used for the first and second layers 152 and 153, and they are attached by suitable means, such as bonding, to the first and second layers 152 and 153 in the positions illustrated.

This results in the sail 150 having a shape such that when the inflatable structure is inflated, with air pressure forcing the first and second layers 152 and 153 apart, the gussets 157 and 158 restraining them in a desired airfoil shape. The gussets 157 and 158 define a series of openings, such as the openings 159, that serve as passages for communicating the pressurized gas through the gussets. Passages 160 and 161 are also provided, and the sail 150 may utilize a plurality of spaced-apart, generally parallel gussets similar to the gussets 157 and 158.

The sail 150 folds at a midregion 162 so that it can be used in the configuration illustrated. It may also be unfolded to an opened configuration. A series of jib hanks, such as a jib hank 163 in FIG. 19, are provided along the midregion 162.

The sail 151 is designed for independent use also. It is similar in many respects to the sail 150, being an inflatable structure dimensioned and arranged for use as a sail on a sailing vessel. It includes valve means for enabling a user to inflate and deflate the inflatable structure while the inflatable structure is so used to thereby vary the shape of the sail, and it may include a head cringle, a foot cringle, a clew cringle, and other structural components suited to the particular application. But unlike the sail 150, it is designed for use as a single-layered sail.

It includes first and second layers 172 and 173 of an airtight material that are dimensioned and arranged to provide an airfoil shape to the sail when the inflatable structure is inflated; and. They are attached together by suitable means such as bonding along an outer edge 174 to form an inflatable structure having an interior 176 that is fully enclosed, enabling the inflatable structure to contain a quantity of pressurized gas for inflation purposes.

A gussets 177 is provided, bonded to the first and second layers 172 and 173 to serve as means for restraining or holding the first and second layers in the airfoil shape when the inflatable structure is inflated. The gusset 177 is fabricated from an air tight material, such as that used for the first and second layers 172 and 173, and it is attached by suitable means, such as bonding, to the first and second layers 172 and 173 in the positions illustrated.

This results in the sail 151 having a shape such that when the inflatable structure is inflated, with air pressure forcing the first and second layers 172 and 173 apart, the gusset 177 restraining them in a desired airfoil shape. The gusset 177 defines a series of openings, such as the openings 179, that serve as passages for communicating the pressurized gas through the gussets. A passages 180 is also provided, and the sail 151 may utilize a series of jib hanks, such as a jib hank 183 in FIG. 20.

Thus, in all of its various embodiments this invention solves many problems associated with the prior art. It can be deflated and stowed when not in use. It is convenient to manipulate, adaptable to different types of existing sails, and highly functional.

Although an exemplary embodiment of the invention has been shown and described, many changes, modifications, and substitutions may be made by one having ordinary skill in the art without necessarily departing from the spirit and scope of the invention. In that regard, it is intended that the scope of the claims include inflatable single and double airfoil sail assemblies without being limited to just an airfoil device that is attachable to an existing sail.

What is claimed is:

1. An airfoil device, comprising:

an inflatable structure for attachment to an existing sail to form a sail assembly, the inflatable structure being dimensioned and arranged to extend over a substantial portion of the existing sail; and valve means for enabling a user to inflate and deflate the inflatable structure while the inflatable structure is so attached to thereby vary the shape of the sail assembly;

the inflatable structure including inner and outer layers that define an enclosed interior suitable for containing a pressurized gas for inflation purposes;

which inner and outer layers are dimensioned and arranged to provide an airfoil shape to the sail assembly when the inflatable structure is inflated;

wherein the airfoil device includes means for attaching the inflatable structure to the existing sail, the means for attaching includes means for attaching the inflatable structure to the existing sail removably, and the means for attaching the inflatable structure to the existing sail removably includes a hook-and-loop type fastener attached to the inflatable structure and reinforced loops of a head portion, foot portion, and clews of the inflatable structure.

2. A device as recited in claim 1, wherein the inflatable structure includes:

first and second portions dimensioned and arranged to extend over a substantial portion of respective ones of first and second sides of an existing single-layered sail; and a central portion intermediate the first and second portions that is dimensioned and arranged to extend around a mast supporting the single-layered sail in order to provide an airfoil shape, at least partially eliminate eddy currents rearward of the mast, and at least partially eliminate leakage between the mast and the sail.

3. A device as recited in claim 2, wherein:

the inflatable structure is configured to enable it to be detached from the existing single-layered sail and opened for use as a wing sail.

4. A device as recited in claim 1, wherein:

the inflatable structure is dimensioned and arranged for placement between the layers of a double-layered sail.

5. A device as recited in claim 1, wherein:

the inflatable structure is dimensioned and arranged to extend over a substantial portion of a first portion of an existing spinnaker sail.

6. A device as recited in claim 1, wherein:

the inflatable structure is dimensioned and arranged to fold over a roller spool of the type used in conjunction with a roller furling jib sail arrangement.

7. A device as recited in claim 1, wherein:

the inflatable structure is dimensioned and arranged to extend over a substantial portion of one side of an existing jib sail with a forward portion of the inflatable structure alongside a luff portion of the existing jib sail;

the device includes a flap that is dimensioned and arranged to overlap the forward portion of the inflatable structure and the luff portion of the existing jib sail for purposes of enhancing airflow past the forward portion and the luff portion.

8. A device as recited in claim 1, wherein:

the inflatable structure is composed of a flexible, airtight material.

9. An airfoil device, comprising:

an inflatable structure for attachment to an existing sail to form a sail assembly, the inflatable structure being dimensioned and arranged to extend over a substantial portion of the existing sail; and valve means for enabling a user to inflate and deflate the inflatable structure while the inflatable structure is so attached to thereby vary the shape of the sail assembly;

the inflatable structure including inner and outer layers that define an enclosed interior suitable for containing a pressurized gas for inflation purposes;

which inner and outer layers are dimensioned and arranged to provide an airfoil shape to the sail assembly when the inflatable structure is inflated;

wherein the device includes means for attaching the inflatable structure to the existing sail, the means for attaching includes means for attaching the inflatable structure to the existing sail removably, and the inflatable structure includes first and second portions dimensioned and arranged to extend over a substantial portion of respective ones of first and second portions of an existing sail, and means for enabling a user to separately inflate and deflate each of the first and second portions;

whereby a user can add sail area below a boom and yet deflate and reef the first portion.

10. An airfoil device comprising:

an inflatable structure for attachment to an existing sail to form a sail assembly, the inflatable structure being dimensioned and arranged to extend over a substantial portion of the existing sail; and valve means for enabling a user to inflate and deflate the inflatable structure while the inflatable structure is so attached to thereby vary the shape of the sail assembly;

the inflatable structure including inner and outer layers that define an enclosed interior suitable for containing a pressurized gas for inflation purposes;

which inner and outer layers are dimensioned and arranged to provide an airfoil shape to the sail assembly when the inflatable structure is inflated;

wherein the device includes means for attaching the inflatable structure to the existing sail;

wherein the means for attaching includes means for attaching the inflatable structure to the existing sail removably;

wherein the inflatable structure is dimensioned and arranged to fold over a roller spool of the type used in conjunction with a roller furling jib sail arrangement; and wherein the device includes a roller spool and a jib, and a plurality of hook-and-loop type fastener strips attached to the jib sail at spaced apart locations;

whereby with the roller spool and jib sail supported in an operational position, a user can adjust the location at which the inflatable structure is attached to the jib sail according to a desired roller spool position.

11. An airfoil device, comprising:

an inflatable structure for attachment to an existing sail to form a sail assembly, the inflatable structure being dimensioned and arranged to extend over a substantial portion of the existing sail; and valve means for enabling a user to inflate and deflate the inflatable structure while the inflatable structure is so attached to thereby vary the shape of the sail assembly;

the inflatable structure including inner and outer layers that define an enclosed interior suitable for containing a pressurized gas for inflation purposes;

which inner and outer layers are dimensioned and arranged to provide an airfoil shape to the sail assembly when the inflatable structure is inflated;

wherein the device includes means for attaching the inflatable structure to the existing sail, wherein the means for attaching includes means for attaching the inflatable structure to the existing sail removably, and the inflatable structure includes separately inflatable and deflatable upper and lower portions to enable a user to separately deflate and reef the lower portion.

12. A device as recited in claim 11, further comprising:

a main sail; and a plurality of hook-and-loop type fastener strips attached to the main sail at spaced apart locations;

whereby with the main sail supported in an operational position, a user can adjust the location at which the inflatable structure is attached to the main sail and reef the lower portion accordingly so that the existing main sail can be reefed with the inflatable structure still operational.

13. An airfoil device, comprising:

an inflatable structure for attachment to an existing sail to form a sail assembly, the inflatable structure being dimensioned and arranged to extend over a substantial portion of the existing sail; and valve means for enabling a user to inflate and deflate the inflatable structure while the inflatable structure is so attached to thereby vary the shape of the sail assembly;

the inflatable structure including inner and outer layers that define an enclosed interior suitable for containing a pressurized gas for inflation purposes;

which inner and outer layers are dimensioned and arranged to provide an airfoil shape to the sail assembly when the inflatable structure is inflated;

wherein the device includes means for attaching the inflatable structure to the existing sail, and the means for attaching includes means for attaching the inflatable structure to the existing sail removably;

wherein the inflatable structure is dimensioned and arranged to extend over a substantial portion of one side of an existing jib sail with a forward portion of the inflatable structure alongside a luff portion of the existing jib sail, and the device includes a flap that is dimensioned and arranged to overlap the forward portion of the inflatable structure and the luff portion of the existing jib sail for purposes of enhancing airflow past the forward portion and the luff portion; and wherein the inflatable structure includes a plurality of reinforced luff loops dimensioned and arranged to receive the jib hanks of an existing sail, and the flap is attached to the forward portion of the inflatable structure and includes a plurality of holes dimensioned and arranged to receive the jib hanks of an existing sail.

14. An airfoil device, comprising:

an inflatable structure for attachment to an existing sail to form a sail assembly, the inflatable structures being dimensioned and arranged to extend over a substantial portion of the existing sail; and valve means for enabling a user to inflate and deflate the inflatable structure while the inflatable structure is so attached to thereby vary the shape of the sail assembly;

the inflatable structure including inner and outer layers that define an enclosed interior suitable for containing a pressurized gas for inflation purposes;

which inner and outer layers are dimensioned and arranged to provide an airfoil shape to the sail assembly when the inflatable structure is inflated;

wherein the inflatable structure includes means for restraining the inner and outer layers in the airfoil shape when the inflatable structure is inflated, and the means for restraining includes at least one gusset attached to the inner and outer layers in a position between the inner and outer layers.

15. A device as recited in claim 14, wherein the gusset defines at least one opening to serve as an air passage.

16. A sail, comprising:

an inflatable structure dimensioned and arranged for use as a sail on a sailing vessel; and valve means for enabling a user to inflate and deflate the inflatable structure while the inflatable structure is so used to thereby vary the shape of the sail;

the inflatable structure including first and second layers that are attached together to define an enclosed interior suitable for containing a pressurized gas for inflation purposes, which first and second layers are dimensioned and arranged to provide an airfoil shape to the sail when the inflatable structure is inflated; and the inflatable structure also including means for restraining the inner and outer layers in the airfoil shape when the inflatable structure is inflated;

wherein the means for restraining includes at least one gusset attached to the inner and outer layers in a position between the inner and outer layers.

17. A sail as recited in claim 16, wherein the gusset defines at least one opening to serve as an air passage.

18. A sail as recited in claim 16, wherein the inflatable structure includes separately inflatable and deflatable portions to enable a user to separately deflate and reef each portion.

19. A sail as recited in claim 11, wherein the inflatable structure is arranged to enable use as a main sail, a roller furling jib sail, or a jib sail other than a roller-furling jib sail.

20. A sail as recited in claim 16, wherein the inflatable structure is configured as a double airfoil sail.

* * * * *

UNITED STATES PATENT AND TRADEMARK OFFICE

CERTIFICATE OF CORRECTION

PATENT NO. : 4,879,961

DATED : Nov. 14, 1989

INVENTOR(S) : Angel R. Aguilera

It is certified that error appears in the above-identified patent and that said Letters Patent is hereby corrected as shown below:

Column 12, line 25 change "structures" to -- structure --.

Column 13, line 4 change "claim 11" to -- claim 16 --.

Signed and Sealed this

Thirteenth Day of November, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,879,961

DATED : November 14, 1989

INVENTOR(S) : Angel R. Aguilera

It is certified that error appears in the above-identified patent and that said Letters Patent is hereby corrected as shown below:

Column 12, lines 60 and 64 change "inner" to -- first -- and change "outer" to -- second --.

Signed and Sealed this

Sixth Day of June, 1995

*Attest:*

Bruce Lehman

BRUCE LEHMAN

*Attesting Officer*

*Commissioner of Patents and Trademarks*